US008870281B1

(12) United States Patent
Boone

(10) Patent No.: US 8,870,281 B1
(45) Date of Patent: Oct. 28, 2014

(54) PORTABLE CHAIR WITH HEAT EXCHANGE POCKETS

(76) Inventor: Anthony A. Boone, Deltona, FL (US)

( * ) Notice: Subject to any disclaimer, the term of this patent is extended or adjusted under 35 U.S.C. 154(b) by 425 days.

(21) Appl. No.: 13/187,738

(22) Filed: Jul. 21, 2011

(51) Int. Cl.
*A47C 7/72* (2006.01)

(52) U.S. Cl.
USPC ..... 297/180.1; 297/180.11; 297/188.04

(58) Field of Classification Search
CPC ..... A47C 7/74; A47C 7/72; A47C 7/742; A47C 31/116; A47C 7/746; A47C 7/748
USPC ..... 297/16.1, 16.2, 45, 180.1, 180.11, 297/180.14, 188.04
See application file for complete search history.

(56) References Cited

U.S. PATENT DOCUMENTS 4,060,276 A * 11/1977 Lindsay ..... 297/180.11
5,641,197 A * 6/1997 Springmann ..... 297/188.11
5,833,309 A * 11/1998 Schmitz ..... 297/180.11
6,516,624 B1 * 2/2003 Ichigaya ..... 62/259.3
6,755,463 B2 * 6/2004 Lardieri et al. ..... 297/35
6,848,746 B2 * 2/2005 Gentry ..... 297/380
7,744,153 B2 * 6/2010 Gentry et al. ..... 297/180.1
7,878,585 B2 * 2/2011 Salisbury ..... 297/180.14
8,123,290 B1 * 2/2012 Aiken et al. ..... 297/180.1
8,419,134 B1 * 4/2013 Yuan ..... 297/410
2001/0027334 A1 10/2001 White
2003/0164626 A1 * 9/2003 Lardieri et al. ..... 297/35
2004/0075311 A1 4/2004 Linder

* cited by examiner

*Primary Examiner* — Sarah B McPartlin
(74) *Attorney, Agent, or Firm* — Crossley Patent Law; Micah C. Gunn

(57) ABSTRACT

A portable chair with heat exchange pockets including a pair of pockets disposed on the rear side of the chair back section, each of the pair of pockets having an insulated layer disposed in an interior cavity lining a rear wall, a bottom wall, a left wall and a right wall; and an impermeable layer conductive to heat disposed parallel the rear wall on the chair back section, through which impermeable layer heat exchange is enabled between a person sitting in the chair and a plurality of extant ice packs or heating packs as preferred.

5 Claims, 4 Drawing Sheets

PORTABLE CHAIR WITH HEAT EXCHANGE POCKETS

BACKGROUND OF THE INVENTION

Various types of portable chairs with cooling pockets are known in the prior art. However, what is needed is a portable chair with heat exchange pockets that includes a pair of pockets disposed on the rear side of a chair back section, into which pockets a plurality of extant ice packs, or heating packs, may be inserted to exchange heat with the person sitting in the chair.

FIELD OF THE INVENTION

The present invention relates to a portable chair with heat exchange pockets, and more particularly, to a portable chair with heat exchange pockets that includes a pair of pockets disposed on the rear side of a chair back section, into which pockets a plurality of extant ice packs, or heating packs as preferred, may be inserted to exchange heat with the person sitting in the chair.

SUMMARY OF THE INVENTION

The general purpose of the portable chair with heat exchange pockets, described subsequently in greater detail, is to provide a portable chair with heat exchange pockets which has many novel features that result in a portable chair with heat exchange pockets which is not anticipated, rendered obvious, suggested, or even implied by prior art, either alone or in combination thereof.

While attending a car show in the summer heat, I noticed a number of people seated in portable folding chairs fanning themselves to remain cool. It became evident that what is needed is a portable folding chair with a pair of heat exchange pockets disposed on the rear side of the chair back section, into which pair of pockets a plurality of ice packs may be inserted to cool the person sitting in the chair. It was also realized that the same pockets could be used for a pair of extant heating packs, should such be desirable when the chair is used in cold climates.

The present device subsequently disclosed in this specification, therefore, includes a portable foldable chair with a pair of heat exchange pockets disposed on the rear side of the chair back section. Each of the pair of pockets includes an open top, a rear wall, a bottom wall, a left wall, and a right wall enclosing an interior cavity, this cavity configured to removably receive an extant ice pack or heating pack, as preferred.

Each of the pair of pockets also has a top flap disposed over the open top. The top flap releasably fastens to the rear wall proximal to the open top by means of a hook and loop fastener. The top flap is thusly moveable between a closed position to an open position to enable access to the interior cavity and insert or remove an ice pack, or heating pack, as needed.

An insulated layer is disposed within the interior cavity lining the rear wall, the bottom wall, the left wall and the right wall. This insulated layer is nonconductive to heat to insulate the interior cavity and lessen heat exchange with the ambient surroundings. An impermeable layer is also disposed within the interior cavity on the rear side of the chair back section, parallel with the rear wall. This impermeable layer is impermeable to water and thus melt water, but conductive of heat to allow heat exchange through the chair back section.

A pair of ventilation holes is disposed on each of the pair of pockets rear wall proximal to the bottom wall to desiccate the interior cavity to limit mildew and mold therein.

Thus has been broadly outlined the more important features of the present portable chair with heat exchange pockets so that the detailed description thereof that follows may be better understood and in order that the present contribution to the art may be better appreciated.

Objects of the present portable chair with heat exchange pockets, along with various novel features that characterize the invention are particularly pointed out in the claims forming a part of this disclosure. For better understanding of the portable chair with heat exchange pockets, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
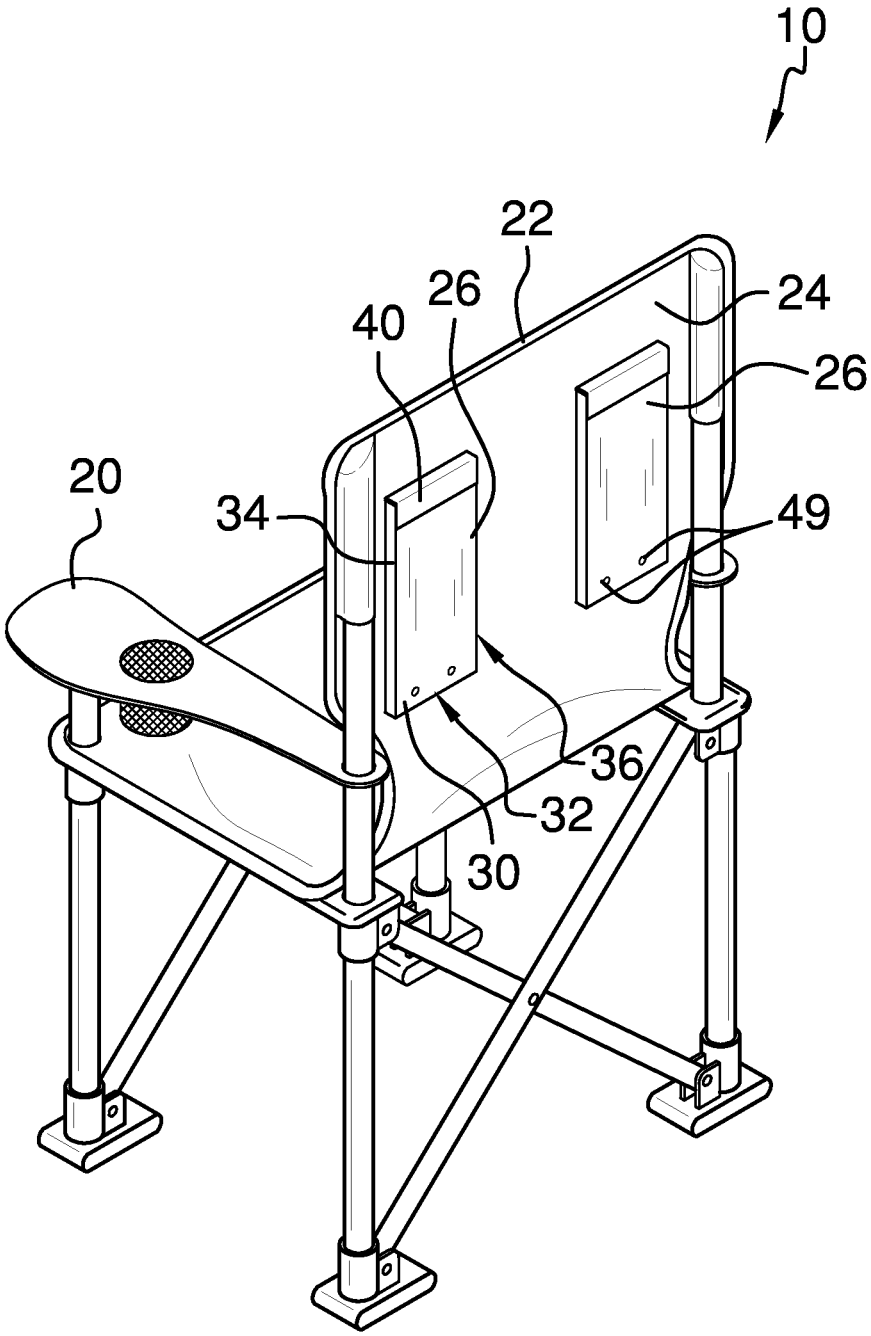
FIG. 1 is an isometric view.
Figure 2:
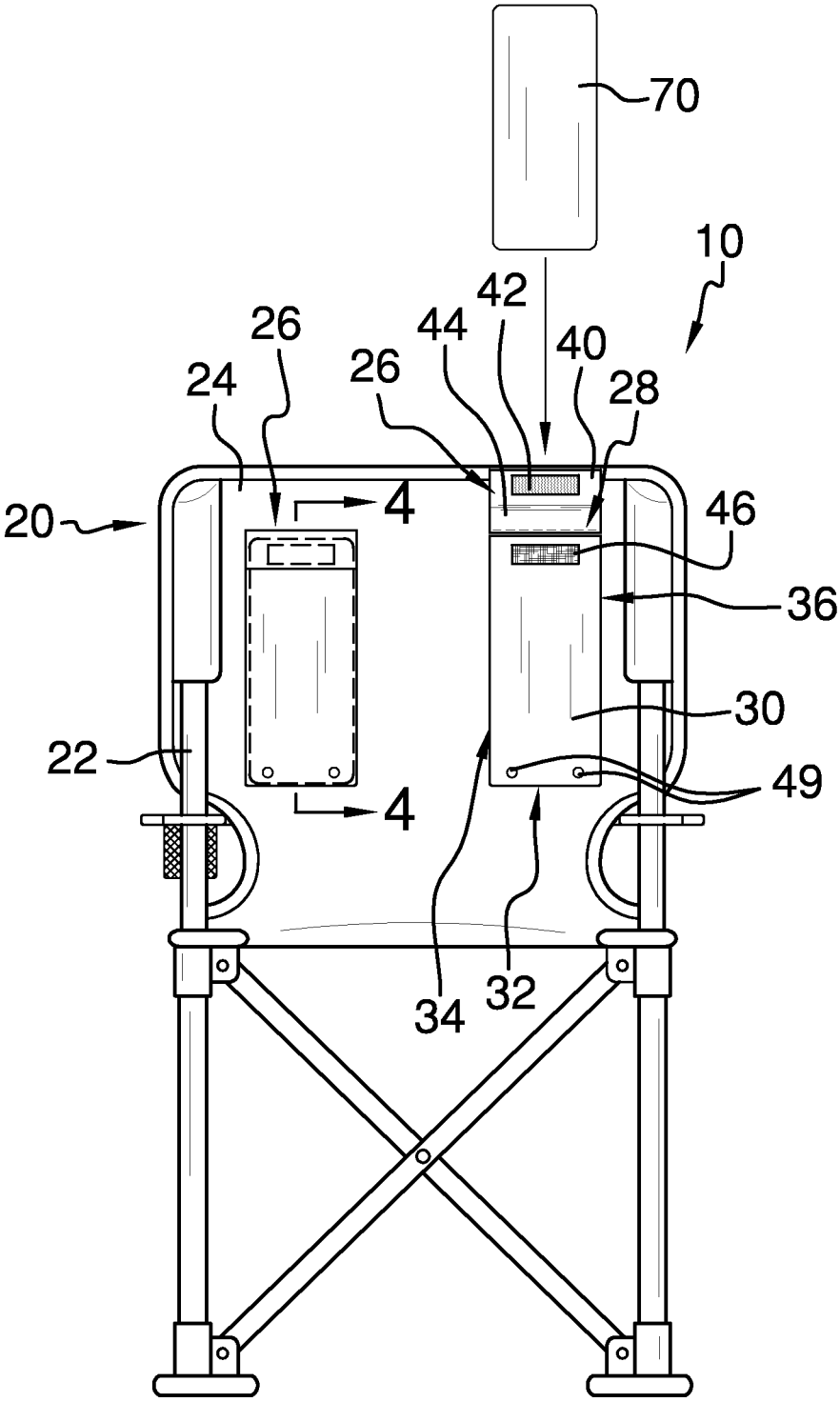
FIG. 2 is a back view.
Figure 3:
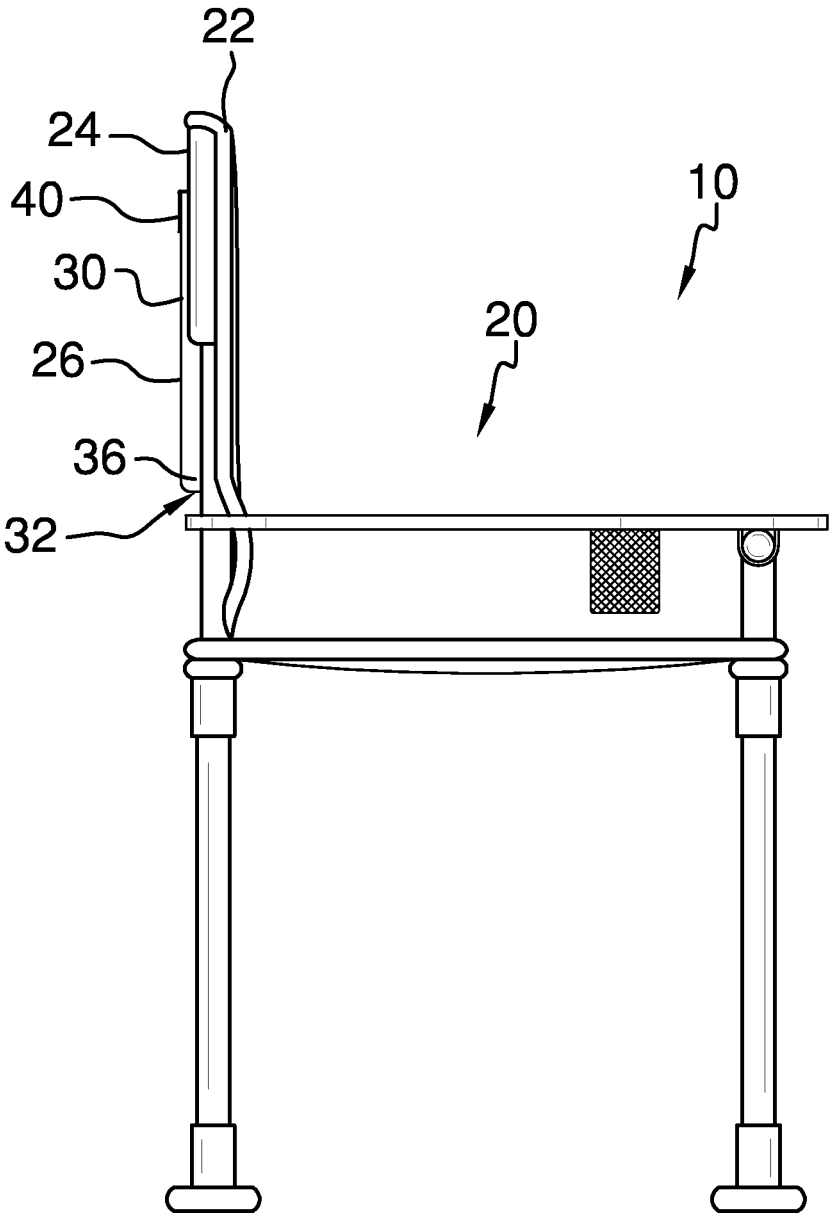
FIG. 3 is a right side view.
Figure 4:
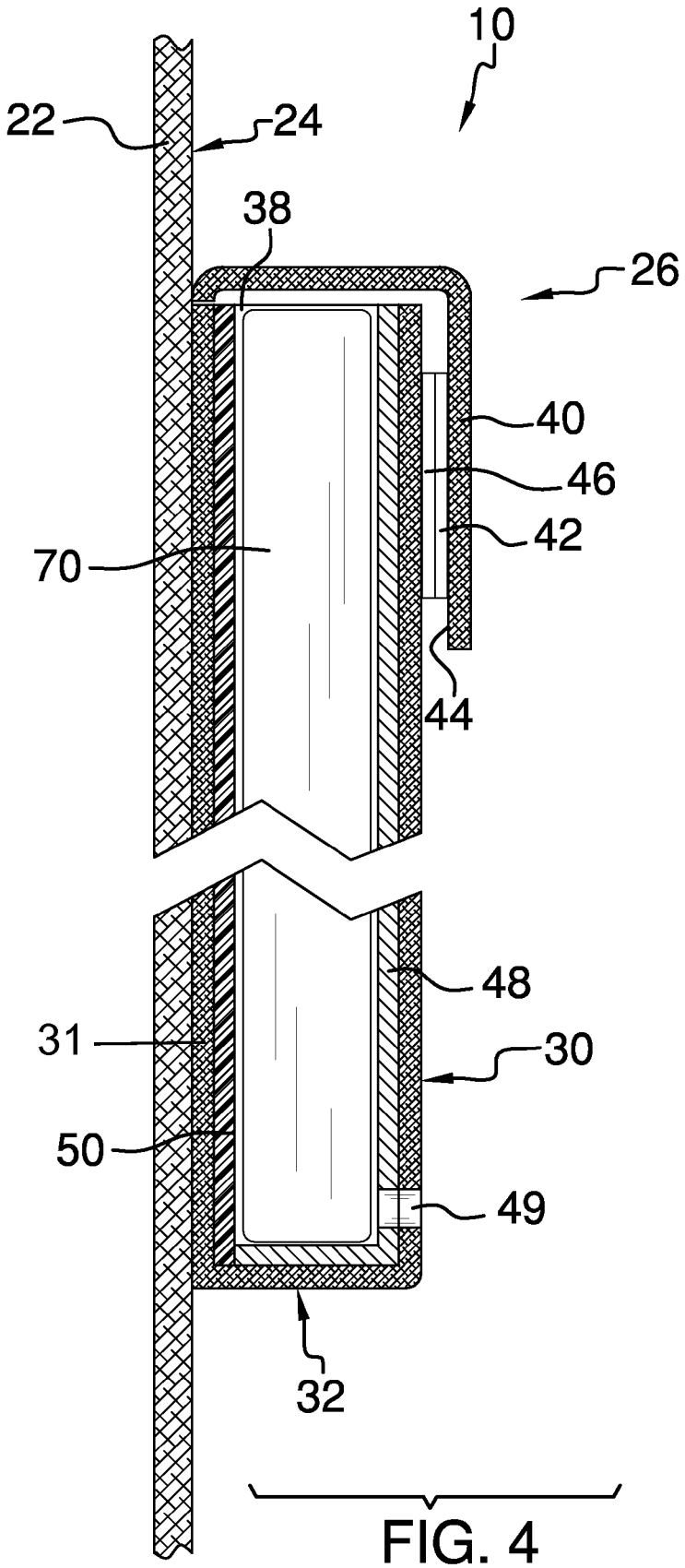
FIG. 4 is a cross section view taken along the line 4-4 of FIG. 2.

With reference now to the drawings, and in particular FIGS. 1 through 4 thereof, example of the instant portable chair with heat exchange pockets employing the principles and concepts of the present portable chair with heat exchange pockets and generally designated by the reference number 10 will be described.

Referring to FIGS. 1 through 4 a preferred embodiment of the present portable chair with heat exchange pockets 10 is illustrated.

The portable chair with heat exchange pockets 10 includes a typical foldable chair 20 having four leg members, a seat, and a back section 22 with a front a rear side 24. A pair of pockets 26 is disposed on the chair 20 back section 22 rear side 24 approximately three inches apart, each of the pair of pockets 26 situated to abut a person's lattisimus dorsi muscles when seated in the chair 20. Each of said pockets 26 includes an open top 28, a rear wall 30, a front wall 31, a bottom wall 32, a left wall 34 and a right wall 36.

The rear wall 30 is disposed parallel to the rear side 24. The bottom wall 32 is disposed perpendicular the rear wall 30, the bottom wall 32 adjoining the rear side 24 and the rear wall 30. The left wall 34 is likewise disposed perpendicular the rear wall 30, but also perpendicular the bottom wall 32; the left wall 34 also adjoining the rear side 24 and the rear wall 30. The right wall 36 is likewise disposed perpendicular the rear wall 30, parallel the left wall 34. The right wall 36 adjoins the rear side 24 and the rear wall 30. Collectively the rear wall 30, the front wall 31, the bottom wall 32, the left wall 34, and the right wall 36 encapsulate an interior cavity 38.

Each of the pair of pockets 26 further includes a top flap 40. This top flap 40 is attached to the rear side 24 of the chair 20 back section 22, the top flap 40 disposed over the open top 28. The top flap 40 is releasably fastenable to the rear wall 30 proximal the open top 28 by means of a hook and loop fastener 42 disposed on an underside 44 of the top flap 40, which hook and loop fastener 42 has a marrying portion 46 disposed on the rear wall 30 proximal to the open top 28. The interior cavity 38 is thus accessible by moving the top flap 40 from a closed position to an open position by means of alternately engaging and disengaging the hook and loop fastener 42 and marrying portion 46.

An insulated layer 48 is disposed within the interior cavity 38. This insulating layer 48 continuously lines the rear wall 30, the bottom wall 32, the left wall 34, and the right wall 36. The insulating layer 48 insulates the interior cavity 38 to lessen temperature changes therein, heat otherwise more easily exchanged with the ambient surroundings.

A pair of ventilation holes 49 is disposed within the insulating layer 48 and the rear wall 30 proximal to the bottom wall 32. This pair of ventilation holes 49 ventilates each of the pair of pockets 26 to desiccate each interior cavity 38 and limit condensation therein. The pair of ventilation holes 49 are disposed proximal the bottom wall 32 to ensure that any excess water or build up of condensation will drain through the pair of ventilation holes 49 to keep the interior cavity 38 drier than may otherwise occur in the absence of said holes 49.

An impermeable layer 50 is disposed within the interior cavity 38 along the entire front wall 31 of each pocket 26. This impermeable layer lines the rear side 24 of the chair 20 back section 22. The impermeable layer 50 is conductive of heat, thereby enabling heat transfer through the chair 20 back section 22 while limiting the transmission of water therethrough.

Each of the pair of pockets 26 is thusly configured to removably receive an extant ice pack 70, and equivalently a heating pack (not shown), as preferred. Said packs are insertable into the pair of pockets, to conduct heat away from and, as preferred, alternately to, a person seated in the chair 20 as desired.

What is claimed is:

1. A portable chair with heat exchange pockets comprising:

a foldable chair having four leg members, a seat, and a back section with a front and a rear side;

a pair of pockets disposed on the chair back section rear side, each of said pockets comprising:

an open top;

a rear wall disposed parallel to the rear side;

a front wall disposed adjacent the rear side of the back section of the chair;

a bottom wall disposed perpendicular the rear wall, the bottom wall adjoining the rear side and the rear wall;

a left wall disposed perpendicular the rear wall and the bottom wall, the left wall adjoining the rear side and the rear wall;

a right wall disposed perpendicular the rear wall and parallel to the left wall, the right wall adjoining the rear side and the rear wall;

an interior cavity disposed between the rear wall, the front wall, the bottom wall, the left wall and the right wall;

a top flap disposed over the open top, the top flap fastenable to the rear wall proximal the open top;

a pair of ventilation holes disposed on the rear wall proximal the bottom wall;

an insulated layer disposed within the interior cavity lining the rear wall, the bottom wall, the left wall, and the right wall;

an impermeable layer conductive to heat disposed within the interior cavity, the impermeable layer disposed within the interior cavity along the entire front wall of each pocket and lining the rear side of the chair back section;

wherein a pair of ice packs and alternately heating packs are removably insertable into said pair of pockets, the ice packs and alternately the heating packs configured to conduct heat away from and alternately to conduct heat to a person seated in the chair.

2. The portable chair with heat exchange pockets of claim 1 wherein each of said pair of pockets are spaced approximately three inches apart positioned to cool the lattissimus dorsi muscles on either side of a person's spine.

3. The portable chair with heat exchange pockets of claim 2 wherein the ventilation holes are configured to ventilate the pockets to desiccate the interior cavity and control condensation therein.

4. The portable chair with heat exchange pockets of claim 3 wherein the top flap is releasably attached to cover the open top by a hook and loop fastener.

5. A portable chair with heat exchange pockets comprising:

a foldable chair having four leg members, a seat, and a back section with a front a rear side;

a pair of pockets disposed on the chair back section rear side, each of said pockets comprising:

an open top;

a rear wall disposed parallel to the rear side;

a front wall disposed adjacent the rear side of the back section of the chair;

a bottom wall disposed perpendicular the rear wall, the bottom wall adjoining the rear side and the rear wall;

a left wall disposed perpendicular the rear wall, the left wall adjoining the rear side and the rear wall;

a right wall disposed perpendicular the rear wall, the right wall adjoining the rear side and the rear wall;

an interior cavity disposed between the rear wall, the front wall, the bottom wall, the left wall and the right wall;

a top flap disposed over the open top, the top flap releasably fastenable to the rear wall proximal the open top;

a hook and loop fastener disposed on the top flap, the hook and loop fastener having a marrying section disposed on the rear wall proximal the open top;

a pair of ventilation holes disposed on the rear wall proximal the bottom wall;

an insulated layer disposed within the interior cavity lining the rear wall, the left side, and the right side;

an impermeable layer conductive to heat disposed within the interior cavity, the impermeable layer disposed within the interior cavity along the entire front wall of each pocket and lining the rear side of the chair back section;

wherein a pair of ice packs and alternately heating packs are removably insertable into said pair of pockets, the ice packs and alternately the heating packs configured to conduct heat away from and alternately to conduct heat to a person seated in the chair.

* * * * *